United States Patent [19]

Auyer et al.

[11] Patent Number: 4,835,033

[45] Date of Patent: May 30, 1989

[54] ARMOR PLATE HAVING TRIANGULAR HOLES

[75] Inventors: Richard A. Auyer, Troy; Robert J. Buccellato, Livonia; Ernest N. Petrick, Ann Arbor; Needangalam S. Sridharan, Ortonville, all of Mich.

[73] Assignee: General Dynamics Land Systems, Inc., Sterling Hts, Mich.

[21] Appl. No.: 162,739

[22] Filed: Mar. 1, 1988

[51] Int. Cl.[4] ..... B30B 3/10

[52] U.S. Cl. ..... 428/131; 428/134; 428/457

[58] Field of Search ..... 428/131, 134, 596, 597, 428/457

[56] References Cited

U.S. PATENT DOCUMENTS

| | | | |
|---|---|---|---|
| 45,536 | 12/1864 | Terwilliger et al. . | |
| 571,358 | 11/1896 | Gilmore | 428/597 |
| 774,959 | 11/1904 | Tresidder . | |
| 874,729 | 12/1907 | DeBobula . | |
| 1,043,416 | 11/1912 | Giolitti . | |
| 1,079,323 | 11/1913 | Benthall . | |
| 1,097,573 | 5/1914 | Wales . | |
| 1,548,441 | 8/1925 | Branovich . | |
| 1,563,420 | 12/1925 | Johnson et al. . | |
| 1,995,484 | 3/1935 | Sullivan . | |
| 2,348,130 | 5/1944 | Hardy, Jr. . | |
| 2,384,157 | 9/1945 | Burke | 428/596 X |
| 2,733,177 | 1/1956 | Meyer . | |
| 2,966,757 | 1/1961 | Faulk | 428/596 X |
| 3,736,838 | 6/1973 | Butterweck et al. . | |
| 3,828,391 | 8/1974 | Sutton et al. | 428/134 X |
| 4,178,859 | 12/1979 | Seiz et al. . | |
| 4,188,435 | 2/1980 | Bartrug | 428/134 X |
| 4,323,625 | 4/1982 | Rush | 428/134 X |
| 4,455,801 | 6/1984 | Merritt . | |

*Primary Examiner*—Nancy A. B. Swisher
*Attorney, Agent, or Firm*—Brooks & Kushman

[57] ABSTRACT

Armor plate (10) is disclosed as including at least one hardened steel plate (14,18) having triangular holes (16,20) arranged in a repeating pattern. Webs (40,42 and 44,46) are located between the triangular holes to provide lightweight armor without any ballistic gaps. The triangular holes (16,20) are shaped and positioned with respect to each other such that the webs (40,42 and 44,46) are generally straight. Each steel plate disclosed has its associated triangular hole (16,20) provided with the same size and shape as each other which are preferably in the shape of equilateral triangles.

10 Claims, 4 Drawing Sheets

ARMOR PLATE HAVING TRIANGULAR HOLES

TECHNICAL FIELD

This invention relates to steel armor plate for protecting objects such as vehicles from incoming objects or from other types of attack that can cause damage.

BACKGROUND ART

Armor plate of hardened steel has been used for many years to provide protection of objects against damage. Vehicles such as tanks, military sites, vaults, and safes, etc. have used steel armor plate to provide such protection.

In order to increase the protection provided, it has previously been proposed to use spaced layers of steel. For example, U.S. Pat. No. 1,548,441 Branovich discloses an armor protected fuel tank wherein a layer of wood and a layer of semi-cured rubber are positioned between a steel tank and an outer armor plate. U.S. Pat. No. 2,348,130 of Hardy, Jr. discloses spaced metal plates between which a layer of rubber is positioned with pockets in the rubber filled with abrasve material such as sand. U.S. Pat. No. 2,733,177 Meyer discloses an elastic cascading impact absorber wherein layers of armor are spaced with respect to each other by elastic material which is disclosed in preferred embodiment as being formed sheet metal springs. U.S. Pat. No. 4,455,801 Merritt discloses a lightweight vault wall wherein layers of metal, stainless steel and aluminum, cover spaced layers of plywood adjacent each of which is provided a layer of expanded metal mesh that is spaced from the other layer of expanded metal mesh by a foamed plastic core.

Two different basic types of armor plate are conventionally utilized at the present time. One type is high-hard armor that is extremely hard and thus capable of preventing penetration of penetrating type of projectiles. The other type is rolled homogenous armor that is somewhat softer than high-hard armor but is more ductile so as to prevent brittle fracture. Prior art references which disclose compositions and processing used in hardening of steel plates include: U.S. Pat. Nos. 774,959 Tresidder; 1,043,416 Giolitti; 1,079,323 Benthall; 1,097,573 Wales; 1,563,420 Johnson et al; and 1,995,484 Sullivan as well as the previously mentioned U.S. Pat. No. 2,733,177 Meyer.

In order to decrease weight, armor plate and the like have previously included holes such as illustrated by U.S. Pat. No. 3,763,838 of Butterweck et al which discloses a protective shielding for vehicles. While circular holes such as disclosed by Butterweck et al or slots are the easiest to produce in armor by punching, such shapes have ballistic gaps that reduce the protection provided. Similarly, square holes which will provide the lowest weight also have ballistic gaps that reduce the protection provided.

Other prior art references disclosing armor plate or the like include U.S. Pat. Nos. 45,536 Terwilliger et al; 874,729 DeBolula; and 4,178,859 Seiz et al.

DISCLOSURE OF INVENTION

An object of the present invention is to provide improved lightweight armor plate for protecting an object from damage by incoming projectiles or otherwise.

In carrying out the above and other objects of the invention, the armor plate disclosed includes a hardened steel plate having triangular holes arranged in a repeating pattern. Webs of the hardened steel plate are located between the triangular holes to provide lightweight armor plate without any ballistic gaps which would occur with circular holes or slots that are easier to form than triangular holes.

In the preferred construction disclosed, the triangular holes in the steel plate are shaped and positioned with respect to each other such that the webs are generally straight. The triangular holes preferably have the same size and shape as each other and are most preferably shaped as equilateral triangles.

In addition to the triangular holes, the hardened steel plate also preferably includes round mounting holes for use in mounting the armor plate for use.

Both the triangular holes and the round mounting holes are formed in the steel plate before hardening thereof by a heat treating operation.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
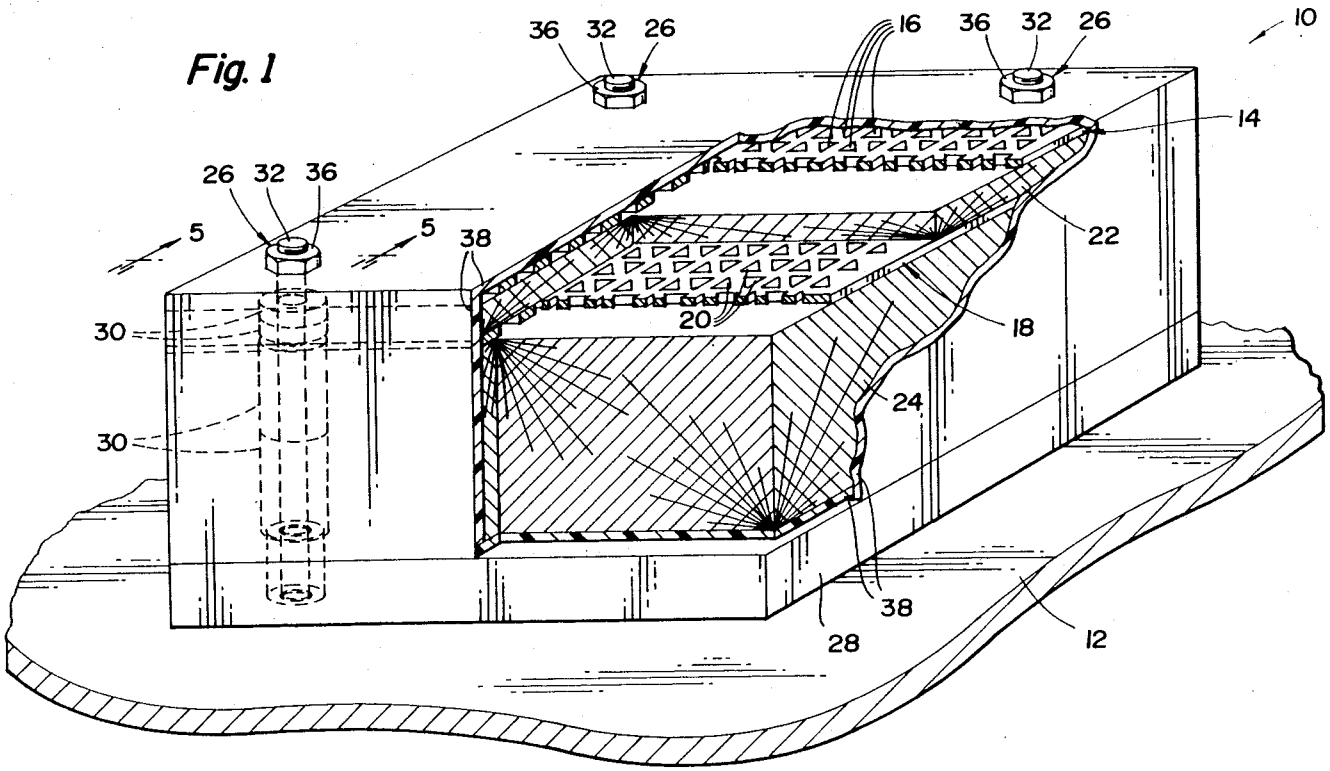
FIG. 1 is a perspective view that is partially broken away in section to illustrate an armor plate module including perforated armor plate embodying the present invention.
Figure 4:
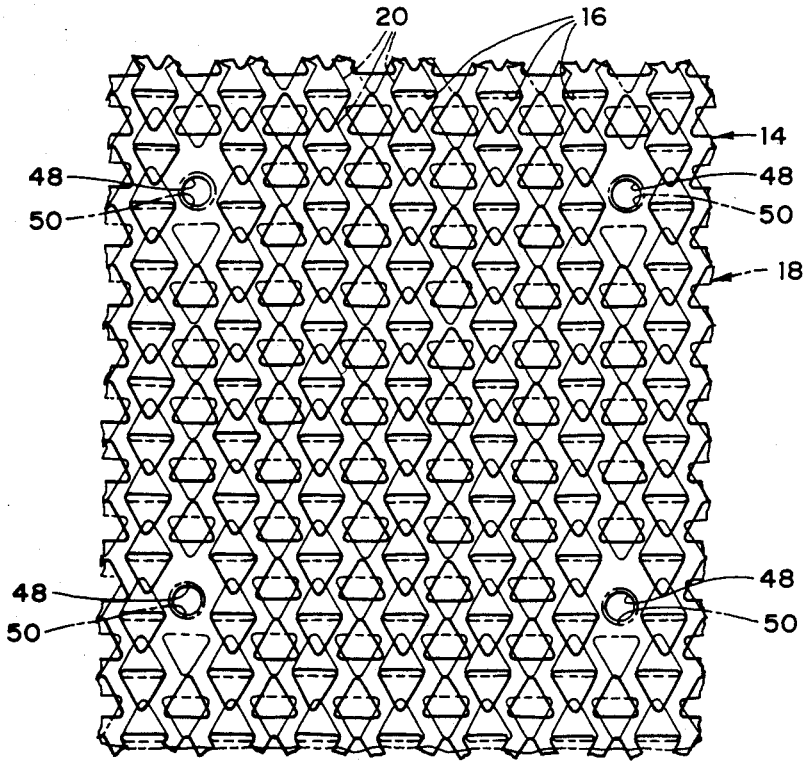
FIG. 4 is a plan view that illustrates an offset relationship of the hole patterns of the outer and inner steel plates of the armor plate module when mounted with respect to each other as illustrated in FIG. 1.

With reference to FIG. 1 of the drawings, an armor plate module generally indicated by 10 provides protection for an object 12 such as the outer skin of a vehicle. The armor plate module 10 includes an assembly of perforated plate armor that embodies the present invention. Armor plate module 10 has an outer perforated steel plate 14 with a pattern of spaced holes 16 and also has an inner perforated steel plate 18 with a pattern of spaced holes 20. As is hereinafter more fully described, each of the outer and inner steel plates 14 and 18 is heat treated to have hardened surfaces and a more ductile core. A pair of fillers 22 and 24 and connectors 26 provide a means for supporting the outer and inner perforated steel plates 14 and 18 in a spaced relationship to each other at outer and inner locations with respect to the object 12 to be protected. In this assembled condition, the pattern of holes 16 of the outer steel plate 14 and the holes 20 of the inner steel plate 18 are offset with respect to each other as illustrated in FIG. 4 to thereby cooperate in preventing a projectile from penetrating straight through both plates.

Figure 5:
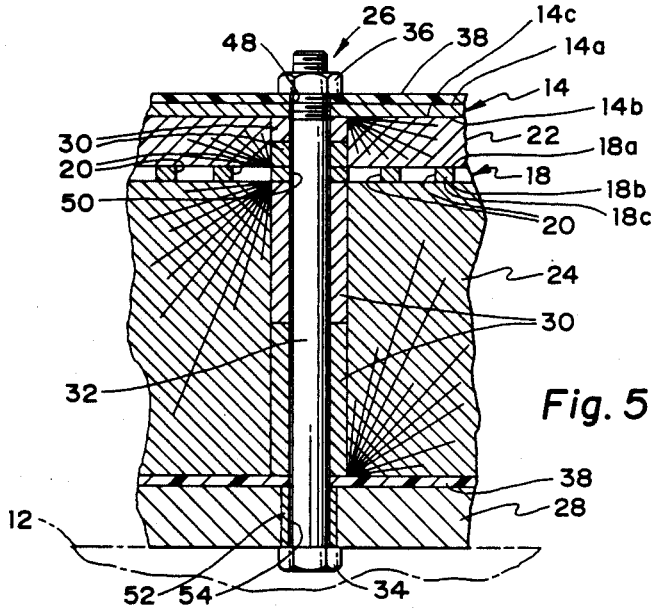
FIG. 5 is a sectional view taken along the direction of line 5—5 in FIG. 1 to illustrate the construction of connectors that connect the outer and inner steel plates to each other in a spaced relationship.

As illustrated in FIG. 5, the outer steel plate 14 has oppositely facing planar surfaces 14*a* and 14*b* which are hardened and also has a more ductal core 14*c* as is hereinafter more fully described. Likewise, the inner plate 18 has oppositely facing planar surfaces 18*a* and 18*b* that are hardened as well as a ductal core 18*c*.

As shown in both FIGS. 1 and 5, the perforated plate armor provided by the module 10 also includes an inner backing plate 28 for stopping any particles that might pass through both perforated steel plates 14 and 18. This inner backing plate 28 is most preferably made from aluminum when taking into consideration both weight and strength factors.

The one filler 22 is located between the outer and inner perforated steel plates 14 and 18 to fill the spacing between these two plates, while the other filler 24 is located between the inner perforated steel plate 18 and the aluminum backing plate 28 to likewise fill the spacing between these two plates. Both of the fillers 22 and 24 can be made from any suitable material that is lightweight while still having the requisite strength such as foam, plastic, or a lightweight wood like balsa wood.

With combined reference to FIGS. 1 and 5, the connectors 26 include spacers 30 that space the outer and inner perforated steel plates 14 and 18 with respect to each other. As illustrated, each connector 26 includes a pair of the spacers 30 that space the outer and inner steel plates 14 and 18 with respect to each other and also includes a pair of spacers 30 that space the inner steel plate 18 with respect to the backing plate 28. It is also possible to utilize a single spacer for separating each of the adjacent pairs of plates; however, use of multiple spacers provides ease of adjustment of the plate spacing by merely adding or removing one or more spacers sized to provide best results. The spacers 30 have annular shapes through which a bolt 32 of the associated connector 26 extends between the outer and inner perforated steel plates 14 and 18 and the aluminum backing plate 28. A head 34 of bolt 32 is engaged with the backing plate 28 as illustrated, while a nut 36 threaded onto the bolt 32 holds the outer steel plate 14 as shown in FIG. 5.

With reference to FIG. 1, the armor plate module 10 also includes an integument 38 in which the outer and inner perforated steel plates 14 and 18 are enclosed along with the first and second fillers 22 and 24. This integument 38 preferably includes a fiberglass mat covered by a veil cloth and functions to encase the outer and inner perforated steel plates 14 and 18 and the first and second fillers 22 and 24 as a module in association with the connectors 26 that also secure the backing plate 28.

Figure 2:
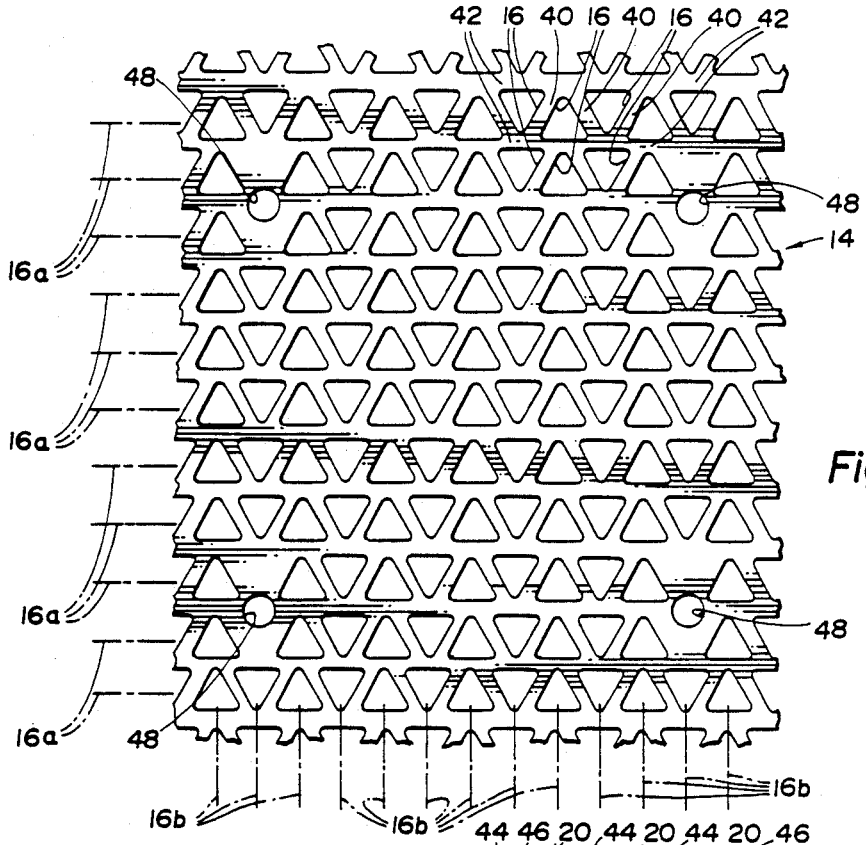
FIG. 2 is a plan view that illustrates the hole pattern of an outer steel plate of the armor plate module.
Figure 3:
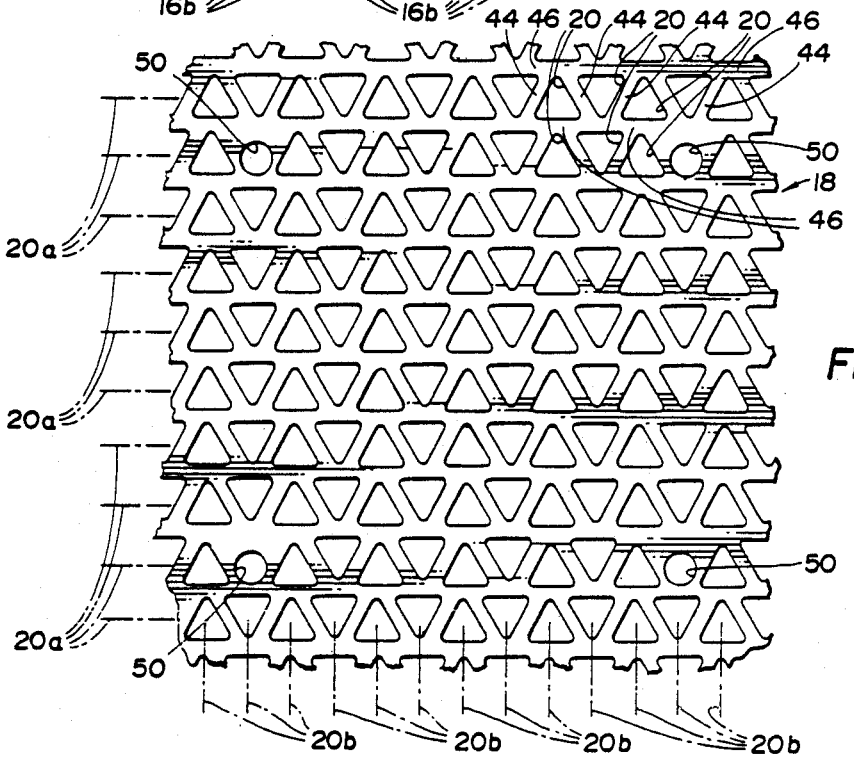
FIG. 3 is a plan view that illustrates the hole pattern of an inner steel plate of the armor plate module.

As illustrated in FIGS. 2 and 3, each of the hardened steel plates 14 and 18 according to the present invention has its associated holes 16 and 20 provided with triangular shapes that are arranged in a repeating pattern. Specifically, the triangular holes 16 of the outer perforated steel plate 14 shown in FIG. 2 are arranged in rows 16*a* and columns 16*b*. Webs 40 of the plate 14 separate the triangular holes 16 of each row 16*a*, while webs 42 separate the triangular holes 16 of each column 16*b*. Likewise, the inner steel plate 18 shown in FIG. 3 has its triangular holes 20 arranged in rows 20*a* and columns 20*b* in the same manner with webs 44 spacing the triangular holes 20 of each column 20*a* and with webs 46 spacing the triangular holes 20 of each column 20*b*. This construction of each steel plate 14 and 18 provides lightweight armor plate without ballistic gaps that would occur with other shapes such as round or slotted holes that are easier to form by a punching operation or with square holes that provide the most lightweight construction possible.

As shown in both FIGS. 2 and 3, the triangular holes 16 and 20 of each of the steel plates 14 and 18 are shaped and positioned with respect to each other such that the associated webs 40,42 and 44,46 are generally straight. The triangular holes 16 and 20 of each steel plate preferably have the same size and shape as each other and are most preferably constructed as equilateral triangles. Adjacent triangular holes 16 and 20 with the equilateral shapes along the rows 16*a* and 20*a* are rotated at 180° with respect to each other to provide the generally straight webs 40 and 44 between the adjacent triangular holes Along the columns 16*b* and 20*b* of each steel plate, the associated triangular holes 16 and 20 have the equilateral shapes thereof provided with the same orientation and are separated from the adjacent triangular holes in the column by the generally straight webs 42 and 46.

Referring to FIG. 2, the outer steel plate 14 is provided with round mounting holes 48 that are positioned generally along the webs 42 that separate one of the rows 16*a* of triangular holes 16 from an adjacent row 16*a*. Each round mounting hole 48 is located in alignment with the triangular holes of one column 16*b* as well as being in alignment with the webs 42 that separate adjacent rows 16*a*.

As illustrated in FIG. 3, the inner steel plate 18 has round mounting holes 50 aligned along associated rows 20*a* of the triangular holes 20. These round mounting holes 50 are also aligned along associated columns 20*b*.

As shown in FIG. 5, the bolt 32 of each connector 26 extends through the round mounting holes 48 and 50 of the outer and inner perforated steel plates 14 and 18 as well as through a bushing 52 in a round mounting hole 54 of the aluminum backing plate 28 to provide the assembly as previously described. The offset hole relationship shown in FIG. 4 is provided by the location of the round mounting holes 48 of the outer plate 14 as shown in FIG. 2 in alignment with the webs 42 between the adjacent rows 16*a*, the location of the mounting holes 50 of the inner steel plate 18 in alignment with the rows 20*a*, and rotation of the outer steel plate 14 180° from the position shown in FIG. 2 with respect to the inner steel plate shown in FIG. 3. This offset relationship of the hole patterns prevents straight line penetration of any projectile of any significant size through both steel plates.

In one preferred embodiment of the armor plate module 10, the outer steel p1ate 14 has a thickness of about ⅜ of an inch and the inner steel plate 18 has a thickness of about ¼ of an inch while the first filler 22 has a thickness of about 1 inch and the second filler 24 has a thickness of about 5 to 7 inches. Both the outer and inner steel plates 14 and 18 have their equilateral triangular holes provided with the same size whose sides when extended at the rounded vertices thereof have a length with the intersecting adjacent sides of about 0.6495 inch such that the maximum circular shape that can pass through each hole has a diameter of ⅜ of an inch. The center of the holes are uniformly spaced along the rows 16*a* and 20*a* by a distance of 0.5540 of an inch, while the centers of the holes are uniformly spaced along the columns 16*b* and 20*b* by a distance of 0.6945 of an inch. The webs 40 and 44 between the triangular holes along each row 16*a* (FIG. 2) and 20*a* (FIG. 3) have a width of about 0.1985 inches. Between the adjacent rows 16a shown in FIG. 2 and and the adjacent rows 20a shown in FIG. 3, the sides of the triangular holes 16 and 20 are spaced from each other by about 0.1320 of an inch with a somewhat greater spacing being provided between each side and the adjacent hole apex due to its rounding. The mounting holes 48 and 50 of each steel plate are spaced from each other by seven rows from each other such that their centers are spaced by about 4.8615 inches along the length of each column. Furthermore, the mounting holes 48 and 50 are spaced from each other by ten columns such that their centers are located about 5.54 inches from each other along each row.

As is hereinafter more fully described, each of the steel plates 14 and 18 previously described is heat treated to provide carbonitride surfaces and a tough, ductile core. The carbonitride surfaces have a hardness of at least 66 on the Rockwell C scale to prevent surface penetration, while the tough, ductile core which is softer than the carbonitride surfaces prevents brittle fracture of the steel plate. More preferably, the carbonitride surfaces have a surface hardness of at least 67 on the Rockwell C scale to provide greater resistance to penetration.

It is possible to manufacture the plate armor from steel plates of the rolled homogenous type. With rolled homogenous armor, the core hardness is in the range of about 45 to 50 on the Rockwell C scale. Many types of rolled homogenous armor are available for use and have the general composition shown by the following Table I.

TABLE I

| Element | | Maximum range percent | Maximum limit percent |
|---|---|---|---|
| Carbon | | 0.10 | 0.28 |
| Manganese: | Up to 1.00% incl. | 0.30 | — |
| | Over 1.00% | 0.40 | — |
| Phosphorus | | — | 0.025 |
| Sulfur | | — | 0.025 |
| Silicon: | Up to 0.60% incl. | 0.20 | — |
| | Over 0.60 to 1.00% incl. | 0.30 | — |
| | Over 1.00% | 0.40 | — |
| Nickel | | 0.50 | — |
| Chromium: | Up to 1.25% incl. | 0.30 | — |
| | Over 1.25% | 0.40 | — |
| Molybdenum: | Up to 0.20% incl. | 0.07 | — |
| | Over 0.20% | 0.15 | — |
| Vanadium: | | 0.15 | — |

It is also possible to manufacture the plate armor from steel plate that is made from high-hard armor. With high-hard armor, the steel plate will have a core hardness in the range of about 52 to 54 on the Rockwell C scale. High-hard armor is also commercially available with the general composition as shown by the following Table II.

TABLE II

| Element | | Maximum range percent | Maximum limit percent |
|---|---|---|---|
| Carbon | | 0.10 | 0.32 |
| Manganese: | Up to 1.00% incl. | 0.30 | — |
| | Over 1.00% | 0.40 | — |
| Phosphorus | | — | 0.025 |
| Sulfur | | — | 0.025 |
| Silicon: | Up to 0.60% incl. | 0.20 | — |
| | Over 0.60 to 1.00% incl. | 0.30 | — |
| Nickel | | 0.50 | — |
| Chromium: | Up to 1.25% incl. | 0.30 | — |
| | Over 1.25% | 0.40 | — |
| Molybdenum: | Up to 0.20% incl. | 0.07 | — |
| | Over 0.20% | 0.15 | — |
| Vanadium: | | 0.15 | — |

The thickness of steel plate utilized to provide the case hardened plate armor is in the range of about 0.15 to 0.5 of an inch. Also, the thickness of the carbonitride surfaces do not have to be particularly deep, about 0.016 of an inch is sufficient to provide the requisite surface hardness that is supported by the tougher, more ductile core. While carbonitride surfaces have previously been utilized to provide greater resistance to wear, such as on rotary shaft wear surfaces, such hardening has never been previously utilized to provide case-hardened plate armor in the manner herein disclosed.

As disclosed, steel plates 14 and 18 each has its triangular holes 16 and 20 formed therethrough prior to the heat treating. It is preferable for the triangular holes to have the same size and shape as each other arranged in the type of repeating pattern previously described. Also, the webs between the holes preferably have a width in the range of about 0.1 to 0.25 of an inch to provide best results.

Figure 6:
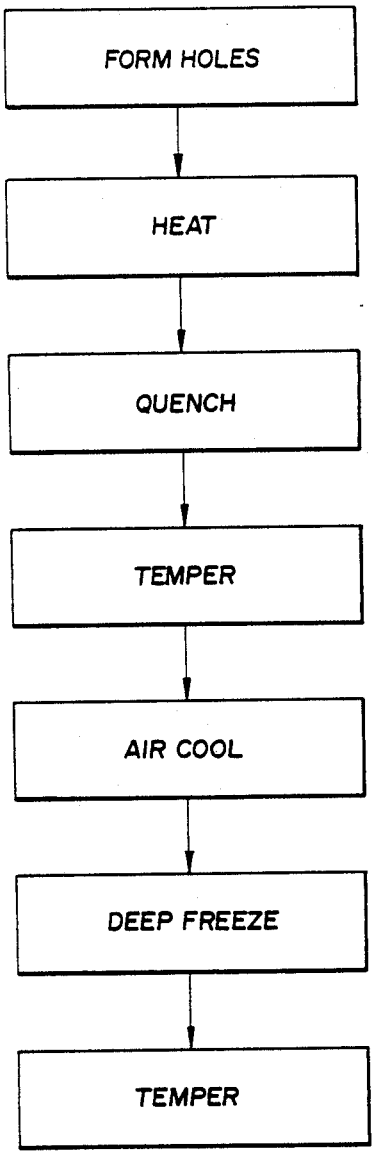
FIG. 6 is a schematic view that illustrates processing used to provide the steel plates of the armor plate module.

The process for performing the case hardening of the steel plate can be best understood by reference to FIG. 6. This process begins by forming the triangular holes prior to the heat treating. While it is preferable to form the holes by a punching operation, it is also possible to provide the holes by drilling, laser cutting, electron beam cutting or any other type of process capable of accurately providing holes through the steel plate.

After the formation of the triangular holes, the steel plate is heated in an atmosphere of nitrogen and carbon to provide the carbonitride surfaces. Cracked ammonia and methane are preferably utilized to readily provide the atmosphere of nitrogen and carbon. The heating in this atmosphere is performed for about 1 to 3 hours at a temperature in the range of about 1300° F. to 1550° F., with the time being more critical than the temperature in controlling the degree of hardening achieved.

After the initial heating, the steel plate is quenched to form martensite. This quenching is preferably performed with oil to prevent distortion and to also insure that all of the austenite is changed to martensite.

After the quench, the steel plate is tempered to change the martensite to tempered martensite and ferrite. This tempering of the steel plate is preferably performed for ½ to 2 hours at a temperature in the range of 275° F. to 325° F. in order to effect the change of the martensite to the tempered martensite and ferrite.

An air cool of the steel plate after the initial tempering precedes a deep freeze step to permit cooling to the ambient without any expenditure of energy. The deep freeze step is then performed to change any retained austensite to martensite. This deep freezing is preferably performed for 1 to 3 hours at a temperature in the range of −50° F. to −150° F.

After the deep freeze step, the steel plate is again tempered to change any additional martensite resulting from the deep freezing to tempered martensite and ferrite. This additional tempering like the initial tempering is preferably performed for ½ to 2 hours at a temperature in the range of 275° F. to 325° F.

The carbonitride processing described above provides hard carbonitride surfaces and a softer but more ductile core such that the resultant perforated steel plate with triangular holes is resistant to fracture as described above.

While the best mode for carrying out the invention has been described in detail, those familiar with the art to which this invention relates will recognize various alternative designs and embodiments for carrying out the invention as defined by the following claims.

What is claimed is:

1. Armor plate comprising: a hardened steel plate having oppositely facing planar surfaces and including triangular holes of the same shape arranged in a repeating pattern of rows and columns; the triangular holes of each row being alternately rotated 180° with respect to each other and the triangular holes of each column having the same orientation as each other; the hardened steel plate having webs between the triangular holes to provide lightweight armor plate without ballistic gaps; and said hardened steel plate being selected from the group consisting of:

(a) rolled homogenous armor having surface hardness of at least 66 on the Rockwell C scale and having a ductile core with a hardness no greater than about 50 on the Rockwell C scale; or (b) high hard armor having surface hardness of at least 66 on the Rockwell C scale and having a ductile core with a hardness no greater than about 54 on the Rockwell C scale.

2. Armor plate as in claim 1 wherein the triangular holes of the repeating pattern are shaped and positioned with respect to each other such that the webs are generally straight.

3. Armor plate as in claim 1 or 2 wherein the triangular holes have the same size as each other.

4. Armor plate as in claim 1 or 2 wherein the triangular holes of the repeating pattern are shaped as equilateral triangles.

5. Armor plate as in claim 4 wherein the steel plate further includes round mounting holes interrupting the repeating pattern of triangular holes.

6. Armor plate as in claim 1 or 2 wherein the triangular holes are formed in the repeating pattern in the steel plate before hardening thereof by a heat treating operation.

7. Armor plate comprising: a hardened steel plate having oppositely facing planar surfaces and including triangular holes of the same shape and size arranged in a repeating pattern of rows and columns; the triangular holes of each row being alternately rotated 180° with respect to each other and the triangular holes of each column having the same orientation as each other; the hardened steel plate having generally straight webs between the triangular holes to prevent lightweight armor plate without ballistic gaps; and said hardened steel plate being selected from the group consisting of:

(a) rolled homogenous armor having surface hardness of at least 66 on the Rockwell C scale and having a ductile core with a hardness no greater than about 50 on the Rockwell C scale; or (b) high hard armor having surface hardness of at least 66 on the Rockwell C scale and having a ductile core with a hardness no greater than about 54 on the Rockwell C scale.

8. Armor plate comprising: a hardened steel plate having oppositely facing planar surfaces and including holes that are shaped as equilateral triangles and arranged in a repeating pattern of rows and columns; the triangular holes of each row being alternately rotated 180° with respect to each other and the triangular holes of each column having the same orientation as each other; the hardened steel plate having generally straight webs between the equilateral triangular holes to provide lightweight armor plate without ballistic gaps; and said hardened steel plate being selected from the group consisting of:

(a) rolled homogenous armor having a surface hardness of at least 66 on the Rockwell C scale and having a ductile core with a hardness no greater than about 50 on the Rockwell C scale; or (b) high hard armor having a surface hardness of at least 66 on the Rockwell C scale and having a ductile core with a hardness no greater than about 54 on the Rockwell C scale.

9. Armor plate comprising: a hardened steel plate having oppositely facing planar surfaces and including holes that are shaped as equilateral triangles of the same size as each other; said equilateral triangular holes being arranged in a repeating pattern of rows and columns; the triangular holes of each row being alternately rotated 180° with respect to each other and the triangular holes of each column having the same orientation as each other; the hardened steel plate having generally straight webs between the equilateral triangular holes to provide lightweight armor plate without ballistic gaps; and said hardened steel plate being selected from the group consisting of:

(a) rolled homogenous armor having surface hardness of at least 66 on the Rockwell C scale and having a ductile core with a hardness no greater than about 50 on the Rockwell C scale; or (b) high hard armor having surface hardness of at least 66 on the Rockwell C scale and having a ductile core with a hardness no greater than about 54 on the Rockwell C scale.

10. Armor plate comprising: a hardened steel plate having oppositely facing planar surfaces and including punched holes that are shaped as equilateral triangles of the same size as each other; said equilateral triangular holes being arranged in a repeating pattern of rows and columns; the triangular holes of each row being alternately rotated 180° with respect to each other and the triangular holes of each column having the same orientation as each other; the hardened steel plate having generally straight webs between the triangular holes to provide lightweight armor plate without ballistic gaps; the hardened steel plate including round mounting holes; and said hardening steel plate being selected from the group consisting of:

(a) rolled homogenous armor having surface hardness of at least 66 on the Rockwell C scale and having a ductile core with a hardness no greater than about 50 on the Rockwell C scale; or (b) high hard armor having surface hardness of at least 66 on the Rockwell C scale and having a ductile core with a hardness no greater than about 54 on the Rockwell C scale.

* * * * *

UNITED STATES PATENT AND TRADEMARK OFFICE
CERTIFICATE OF CORRECTION

PATENT NO. : 4,835,033

DATED : May 30, 1989

INVENTOR(S) : Richard A. Auyer, et al

It is certified that error appears in the above-identified patent and that said Letters Patent is hereby corrected as shown below:

Title page, References Cited "4,323,625" should be --4,323,605--.

Column 4, Line 16, after "holes" insert a --.--.

Column 4, Line 52, "plate" should be --plate--.

Column 7, Line 46, Claim 7, "prevent" should be --provide--.

Column 8, Line 51, Claim 10, "hardening" should be --hardened--.

Signed and Sealed this

Ninth Day of July, 1991

*Attest:*

*Attesting Officer*

HARRY F. MANBECK, JR.

*Commissioner of Patents and Trademarks*